US007841626B2

(12) United States Patent
Peleman

(10) Patent No.: US 7,841,626 B2
(45) Date of Patent: Nov. 30, 2010

(54) BINDING ELEMENT

(75) Inventor: Guido Peleman, Puurs (BE)

(73) Assignee: Unibind (Cyprus) Limited, Nicosia (CY)

( * ) Notice: Subject to any disclaimer, the term of this patent is extended or adjusted under 35 U.S.C. 154(b) by 0 days.

(21) Appl. No.: 11/213,834

(22) Filed: Aug. 30, 2005

(65) Prior Publication Data

US 2006/0061085 A1 Mar. 23, 2006

(30) Foreign Application Priority Data

Sep. 20, 2004 (BE) ..... 2004/0459

(51) Int. Cl.
*B42D 1/00* (2006.01)
*B42C 9/00* (2006.01)

(52) U.S. Cl. ..... 281/21.1; 281/27.3; 412/6; 412/8

(58) Field of Classification Search ..... 281/21.1, 281/3.1, 27.3; 412/6, 8, 37, 28; 156/908
See application file for complete search history.

(56) References Cited

U.S. PATENT DOCUMENTS

| | | | | | |
|---|---|---|---|---|---|
| 4,244,069 | A * | 1/1981 | Hale | 412/33 |
| 4,289,330 | A * | 9/1981 | Wiermanski | 281/21.1 |
| 4,371,194 | A * | 2/1983 | Wang et al. | 281/21.1 |
| 4,441,950 | A * | 4/1984 | Lolli | 156/216 |
| 4,496,617 | A * | 1/1985 | Parker | 281/21.1 |
| 4,928,995 | A * | 5/1990 | Pickering et al. | 281/29 |
| 5,061,139 | A * | 10/1991 | Zoltner | 281/21.1 |
| 5,066,182 | A * | 11/1991 | Stonebraker et al. | 281/21.1 |
| 5,078,563 | A * | 1/1992 | Lolli | 412/8 |
| 5,425,554 | A * | 6/1995 | Lamanna | 281/21.1 |
| 5,733,087 | A * | 3/1998 | Gwyn | 412/8 |
| 5,779,423 | A * | 7/1998 | Bermingham | 281/21.1 |
| 6,540,929 | B2 * | 4/2003 | Wicki et al. | 216/28 |
| 6,558,099 | B2 * | 5/2003 | Mendoza et al. | 281/21.1 |
| 6,746,050 | B2 * | 6/2004 | Peleman | 281/21.1 |
| 6,861,140 | B2 * | 3/2005 | Peleman | 428/354 |
| 2004/0240965 | A1 * | 12/2004 | Schuder et al. | 412/4 |
| 2005/0052016 | A1 * | 3/2005 | Peleman | 281/21.1 |
| 2005/0104361 | A1 * | 5/2005 | Peleman | 281/21.1 |

FOREIGN PATENT DOCUMENTS

| | | |
|---|---|---|
| EP | 0334260 A | 9/1989 |
| EP | 0363345 A | 4/1990 |
| EP | 1213155 A1 | 6/2002 |
| GB | 2 197 256 | 5/1988 |
| JP | 7-108783 | 4/1995 |
| JP | 07108783 | 4/1995 |

* cited by examiner

*Primary Examiner*—Dana Ross
*Assistant Examiner*—Kyle Grabowski
(74) *Attorney, Agent, or Firm*—Bacon & Thomas, PLLC

(57) ABSTRACT

Binding element in the form of a U-shaped profile (2) made of a heat-conducting material, which. U-shaped profile (2) consists of a back wall (3) and two standing side walls (4), such that a space (5) is enclosed whereby, in the above-mentioned space (5), on the above-mentioned back wall (3) is provided a layer of glue (6) which melts under the influence of heat, and whereby on at least one of the above-mentioned side walls (4) is provided an end leaf (8), characterized in that in the above-mentioned space (5), at least on the side wall (4) onto which the above-mentioned end leaf (8) is provided, is also provided a layer of glue (7) which melts under the influence of heat.

4 Claims, 2 Drawing Sheets

BINDING ELEMENT

BACKGROUND OF THE INVENTION

1. Field of the Invention

The present invention concerns a binding element.

More specifically, the present invention concerns a binding element in the form of a U-shaped profile which is made of a heat-conducting material, which U-shaped profile consists of a back wall and two standing side walls, such that a space is enclosed, whereby in the above-mentioned space, on the above-mentioned back wall, is provided a layer of glue which melts under the influence of heat and whereby an end leaf is provided on at least one of the above-mentioned side walls.

In order to bind a bundle of leaves, these leaves are put in the known manner in the above-mentioned space with one edge, and the binding element, together with the leaves, is provided in an appropriate binding device so as to heat the binding element to a temperature whereby the above-mentioned glue becomes liquid and is spread around the above-mentioned edge of the leaves, after which the binding element with the leaves is left to cool so as to make the glue harden again and to thus obtain a bound bundle whose leaves are glued in the binding element.

2. Discussion of the Related Art

In practice it appears that, while the bundle of leaves is being placed in the above-mentioned space of the binding element, the farthest leaves and in particular the front and back leaves often do not slide into the above-mentioned layer of glue, as they keep sticking to the above-mentioned end leaves, for example due to electrostatic attraction between the end leaves and said farthest leaves.

As a result, a good adhesion of said farthest leaves in the above-mentioned layer of glue is often not possible, such that they often come loose out of the above-mentioned binding element.

SUMMARY OF THE INVENTION

The present invention aims to remedy the above-mentioned and other disadvantages.

To this end, the present invention concerns a binding element in the form of a U-shaped profile made of a heat-conducting material, which U-shaped profile consists of a back wall and two standing side walls, such that a space is enclosed whereby, in the above-mentioned space, on the above-mentioned back wall, is provided a layer of glue which melts under the influence of heat, and whereby on at least one of the above-mentioned side walls is provided an end leaf which is characterized in that in the above-mentioned space, at least on the side wall onto which the above-mentioned end leaf is provided, is also provided a layer of glue which melts under the influence of heat.

An advantage of such a binding element according to the invention is that the farthest leaves of a bundle of leaves to be bound, while this bundle of leaves is being provided in the above-mentioned space of the binding element, always come into contact with a layer of glue, even if they stick to the end leaves in an electrostatic manner, more in particular with the layer of glue which is provided on the side walls of the binding element, such that these leaves can still be glued tight without coming loose.

The above-mentioned layer of glue which is provided on the side wall is preferably made such that, while a bundle of leaves to be bound is being provided in the binding element, the farthest leaves of this bundle of leaves cannot remain hanging on the top edge of this layer of glue, more particularly, among other things, because the thickness of this layer of glue is as large as or smaller than the thickness of the above-mentioned end leaf.

BRIEF DESCRIPTION OF THE DRAWINGS

In order to better explain the characteristics of the invention, the following preferred embodiment of a binding element according to the invention is given as an example only without being limitative in any way, with reference to the accompanying drawings, in which.

DESCRIPTION OF THE PREFERED EMBODIMENTS

Figure 1:
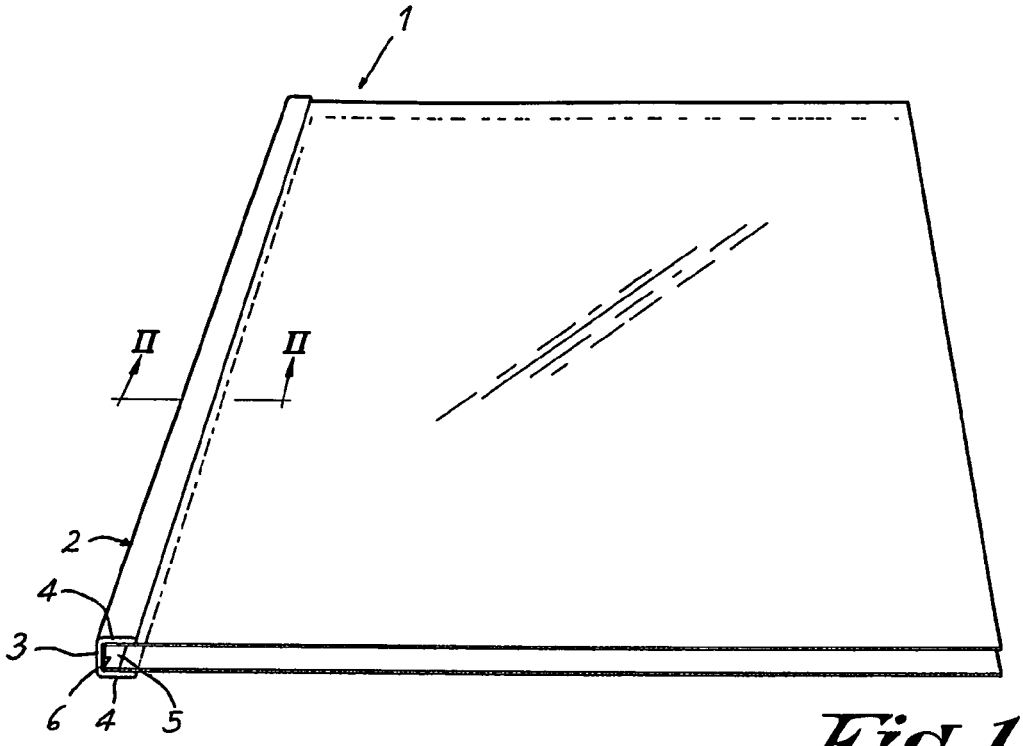
FIG. 1 schematically represents a view in perspective of a binding element according to the invention.
Figure 2:
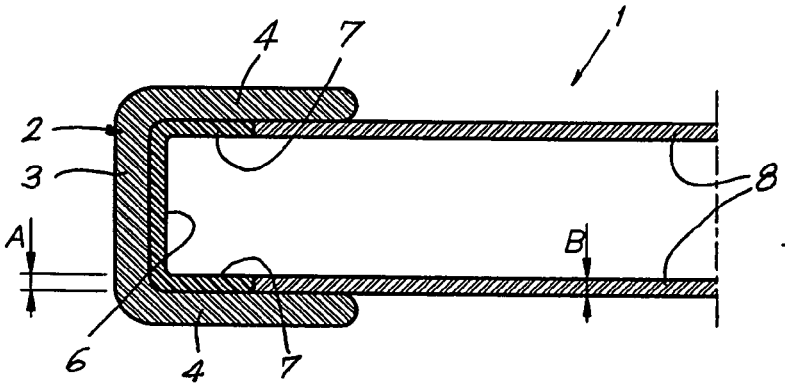
FIG. 2 represents a section according to line II-II in FIG. 1.

FIGS. 1 and 2 represent a binding element 1 according to the invention which mainly consists of a U-shaped profile 2 made of a heat-conducting material, which U-shaped profile 2 consists of a back wall 3 and two standing side walls 4, such that a space 5 is enclosed.

For the above-mentioned heat-conducting material of the U-shaped profile 2, use is preferably made of a metal, a ceramic material or the like.

In the above-mentioned space 5, on the back wall 3, a layer of glue 6 is provided which melts under the influence of heat.

In this case, in the above-mentioned space 5, on each of the above-mentioned side walls 4, is also provided a layer of glue 7 which melts under the influence of heat.

A binding element 1, as represented in the figures, is moreover provided with two end leaves 8, for example in the shape of transparent synthetic leaves, provided against the above-mentioned side walls 4, for example by means of a glue with a higher melting temperature than that of the above-mentioned layers of glue 6 and 7.

The above-mentioned layer of glue 7 in this case extends from the above-mentioned layer of glue 6 on the back wall 3 to the edge of the end leaf 8.

Figure 3:
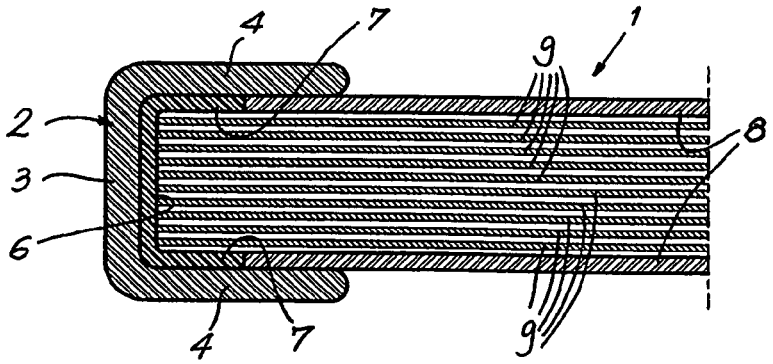
FIG. 3 represents the use of the binding element according to the invention according to FIG. 2.

The use of a binding element 1 according to the invention is very simple and as represented in FIG. 3.

In order to bind a bundle of leaves 9 in a binding element 1 according to the invention, these leaves 9 are provided in the known manner with one edge in the above-mentioned space 5.

The farthest leaves hereby slide along the layers of glue 7 on the side walls 4 of the binding element 1, as the thickness A of these layers of glue 7 is just as large as or less large than the thickness B of the end leaves 8, and as they extend up to the edge of said end leaves 8.

Next, the binding element 1 is heated in the known manner up to a temperature whereby the layers of glue 6 and 7 become liquid and are spread around the above-mentioned leaves 9.

Next, the binding element 1 with the leaves 9 are left to cool so as to make the layers of glue 6 and 7 harden again, and to thus obtain a bound bundle whose leaves 9 are glued in the binding element 1.

Thanks to the presence of the layers of glue 7 on the side walls of the binding element 1, the farthest leaves of the bundle of leaves 9 are fixed as well, even when these farthest leaves have not been provided entirely into the above-mentioned layer of glue 6 on the back wall 3.

Figure 4:
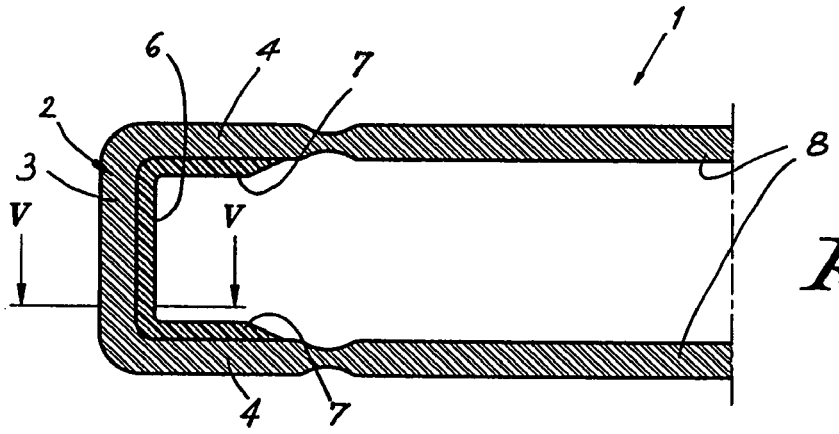
FIG. 4 represents a variant of a binding element according to FIG. 2.

FIG. 4 represents a variant of a binding element 1 according to the invention whereby the end leaves 8 are provided in the extension of the above-mentioned side walls 4, for example as they form a whole with it.

The above-mentioned layers of glue 7 are in this case conical towards the end leaves 8.

The use of such an embodiment of a binding element 1 is analogous to that of the above-described embodiment.

While a bundle of leaves 9 to be bound is being provided, leaves 9 are guided into the above-mentioned space 5 by the conical part of the layers of glue 7.

Thus is avoided that the farthest leaves of the above-mentioned bundle of leaves 9, while being provided in the U-shaped profile 2, remain sticking on the edge of the above-mentioned layers of glue 7 and do not slide any further in the U-shaped profile 2, such that, as a consequence, the farthest leaves will be inserted with certainty up against the back wall 3 and will make contact with the layers of glue 7 on the side walls 4.

It is clear that only one such end leaf 8 can be provided and that it can also be made of other materials, such as for example paper.

Naturally, the above-mentioned layer of glue 7 according to the invention can only be provided on one of the side walls 4, and the above-mentioned layers of glue 7 must not extend up to the layer of glue 6 on the back wall 3, but they can also be realized as separate layers of glue at a distance from the layer of glue 6 on the back wall 3.

Figure 5:
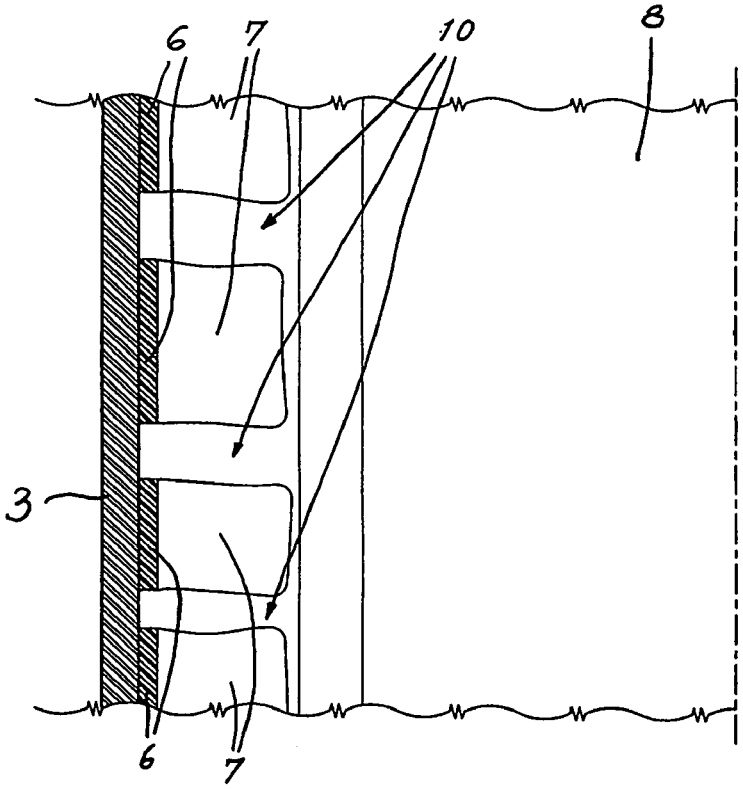
FIG. 5 represents a section according to line V-V in FIG. 4.

The above-mentioned layers of glue 7 can be made, according to the invention, as a continuous layer over the entire length of the binding element 1, but they can also be formed of one or several glue segments provided on the respective side walls 4 of the binding element 1, as shown in FIG. 5, which represents a cross-sectional view according to line V-V in FIG. 4.

According to a preferred characteristic, the above-mentioned U-shaped profile 2 is at least partly provided with a coating of paper, plastic or the like, which is not represented in the figures.

The present invention is by no means limited to the embodiments given as an example and represented in the figures; on the contrary, such a binding element according to the invention can be made in all sorts of shapes and dimensions while still remaining within the scope of the invention.

The invention claimed is:

1. A binding element comprising:

a U-shaped profile for binding a bundle of leaves by inserting the bundle of leaves in the binding element and applying heat to the U-shaped profile, the U-shaped profile made of a rigid heat-conducting material, said U-shaped profile comprises a back wall and first and second standing side walls, said walls enclosing a space;

a first layer of glue on said back wall in said space which melts under the influence of the heat applied, the binding element further comprising an end leaf fixed on the inside of at least the first side wall at a distance from said first layer of glue on the back wall;

wherein, in said space, at least on the first side wall on which the end leaf is provided, there is also provided a second layer of glue between the first layer of glue and an edge of the end leaf, wherein the second layer of glue melts under the influence of the heat applied and wherein the second layer of glue extends from the first layer of glue towards and up to the edge of the end leaf and has a thickness that is the same as or less than a thickness of the end leaf, such that when a bundle of leaves to be bound is inserted into the space, the farthest leaves of the bundle cannot remain hanging on a top edge of the second layer of glue, and the first and second layers of glue are configured to bind the leaves of a bundle of leaves to be bound.

2. The binding element according to claim 1, wherein the second layer of glue which melts under the influence of heat is provided on both the first and second side walls of the binding element.

3. The binding element according to claim 1, wherein the second layer of glue on the first side wall is formed of one or several glue segments.

4. The binding elements according to claim 1, wherein the second layer of glue extends continuously from the first layer of glue up to the edge of the end leaf which is fixed to the inside of the side wall.

* * * * *